United States Patent [19]

Strachan

[11] 4,186,284

[45] Jan. 29, 1980

[54] ELECTRICAL SWITCH ASSEMBLY HAVING ROTARY AND AXIALLY OPERATED SWITCHES

[75] Inventor: Robert Strachan, Wolcott, Conn.

[73] Assignee: Robertshaw Controls Company, Richmond, Va.

[21] Appl. No.: 881,530

[22] Filed: Feb. 27, 1978

[51] Int. Cl.[2] ..... H01H 9/00; H01H 3/42

[52] U.S. Cl. ..... 200/1 A; 200/4; 200/17 R; 200/153 K; 200/153 LB

[58] Field of Search ..... 200/1 R, 1 A, 1 TK, 200/1 B, 4, 5 R, 6 R, 6 A, 6 B, 6 BB, 6 BA, 6 C, 17, 153 K, 153 LB

[56] References Cited

U.S. PATENT DOCUMENTS

| | | | |
|---|---|---|---|
| 2,280,438 | 4/1942 | Matthews | 200/1 A |
| 2,292,179 | 8/1942 | Tubbs | 200/1 A |
| 2,462,495 | 2/1949 | Harrison, Jr. | 200/4 X |
| 2,695,339 | 11/1954 | Williams, Jr. | 200/1 A |
| 2,695,343 | 11/1954 | Howard | 200/6 C X |
| 2,748,204 | 5/1956 | Woods et al. | 200/153 LB X |
| 2,786,904 | 3/1967 | Hewes et al. | 200/4 |
| 3,030,478 | 4/1962 | Paolino, Jr. | 200/1 A X |
| 3,408,463 | 10/1968 | Warlass | 200/6 BB X |
| 3,419,684 | 12/1968 | Lord et al. | 200/4 |
| 3,669,533 | 6/1972 | De Angelis | 200/4 |

FOREIGN PATENT DOCUMENTS

| | | | |
|---|---|---|---|
| 2611021 | 9/1976 | Fed. Rep. of Germany | 200/6 C |
| 1113558 | 5/1968 | United Kingdom | 200/4 |

*Primary Examiner*—James R. Scott
*Attorney, Agent, or Firm*—Candor, Candor & Tassone

[57] ABSTRACT

An electrical switch construction having two pairs of cooperable contacts each pair of which is adapted to be opened and closed independently of the other pair, a single manipulator being carried by the construction and being operatively associated with the pairs of contacts to operate either pair independently of the other pair by a cam member carried by the manipulator and having a generally rectangular profile defined by two right angle corners and two rounded corners.

2 Claims, 6 Drawing Figures

ELECTRICAL SWITCH ASSEMBLY HAVING ROTARY AND AXIALLY OPERATED SWITCHES

BACKGROUND OF THE INVENTION

1. Field of the Invention

This invention relates to an improved electrical switch construction having a single manipulator means and to a method of making such an electrical switch construction or the like.

2. Prior Art Statement

It is known to provide a switch construction, such as a control panel, that carries at least two pairs of cooperable contact means with each pair being adapted to be opened and closed independently of the other pair by a single manipulator means.

For example, see the following two U.S. patents:

(1) U.S. Pat. No. 3,419,684–Lord et al;

(2) U.S. Pat. No. 3,669,533–DeAngelis.

SUMMARY OF THE INVENTION

It is a feature of this invention to provide an electrical switch construction having at least two pairs of cooperable contact means each pair of which is adapted to be opened and closed independently of the other pair and being controlled by a single manipulator means that can operate either pair of contact means independently of the other pair of contact means.

In this manner, a simplified electrical switch construction can be provided that is relatively inexpensive and easy to manufacture.

In particular, one embodiment of this invention provides an electrical switch construction having two pairs of cooperating contact means each pair of which is adapted to be opened and closed independently of the other pair. A single manipulator means is carried by the construction and is operatively associated with the pairs of contact means to operate either pair independently of the other pair by cam member carried by the manipulator means and having a generally rectangular profile defined by two right angle corners and two rounded corners.

If desired, a third pair of cooperable contact means can be carried by the switch construction and can be opened and closed independently of the previously described two pairs of contact means, the single manipulator means also being operatively associated with the third pair of contact means to operate the third pair of contact means independently of the two pairs of contact means.

Accordingly, it is an object of this invention to provide an improved electrical switch construction having one or more of the novel features of this invention as set forth above or hereinafter shown or described.

Another object of this invention is to provide a method of making such an electrical switch construction or the like, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
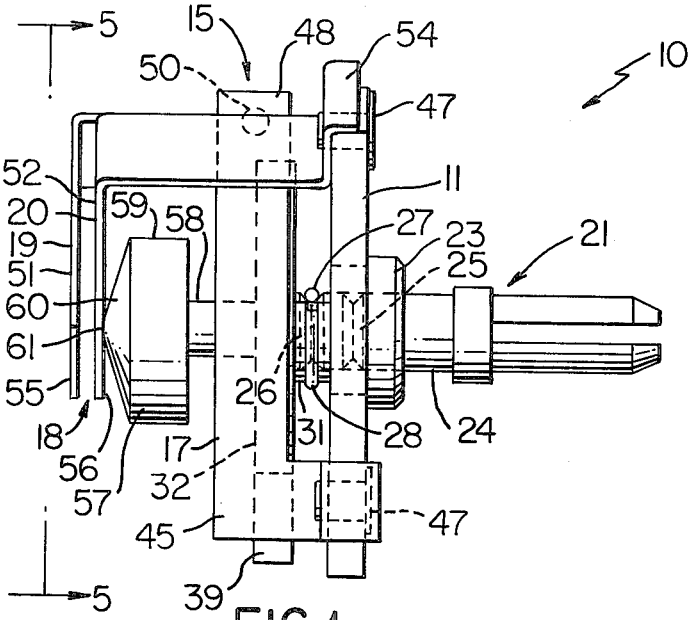
FIG. 1 is a side view of the electrical switch construction of this invention.

While the various features of this invention are hereinafter described and illustrated as being particularly adapted to provide an electrical switch construction for controlling a timer means, such as electronic alarm clock, it is to be understood that the various features of this invention can be utilized singly or in any combination thereof to provide an electrical switch construction for other devices as desired.

Therefore, this invention is not to be limited to only the embodiment illustrated in the drawings, because the drawings are merely utilized to illustrate one of the wide variety of uses of this invention.

Figure 3:
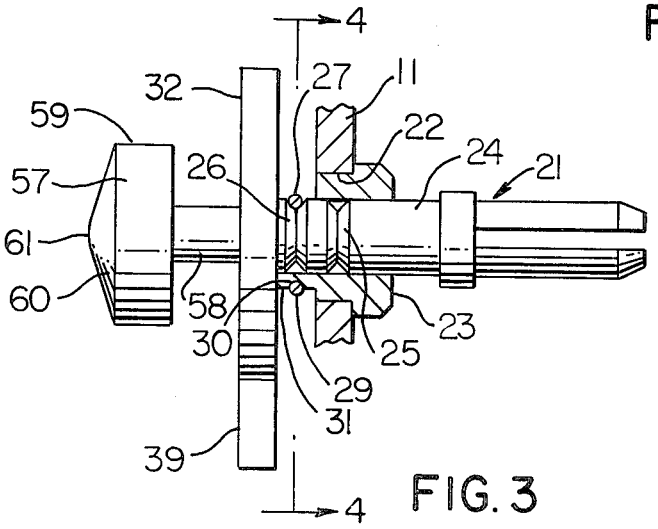
FIG. 3 is a fragmentary broken away partial cross-sectional view illustrating the manipulator means of the electrical switch construction of FIG. 1.
Figure 4:
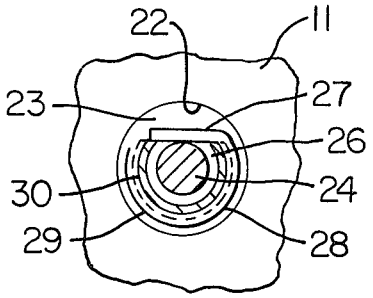
FIG. 4 is a fragmentary cross-sectional view taken on line 4—4 of FIG. 3.
Figure 5:
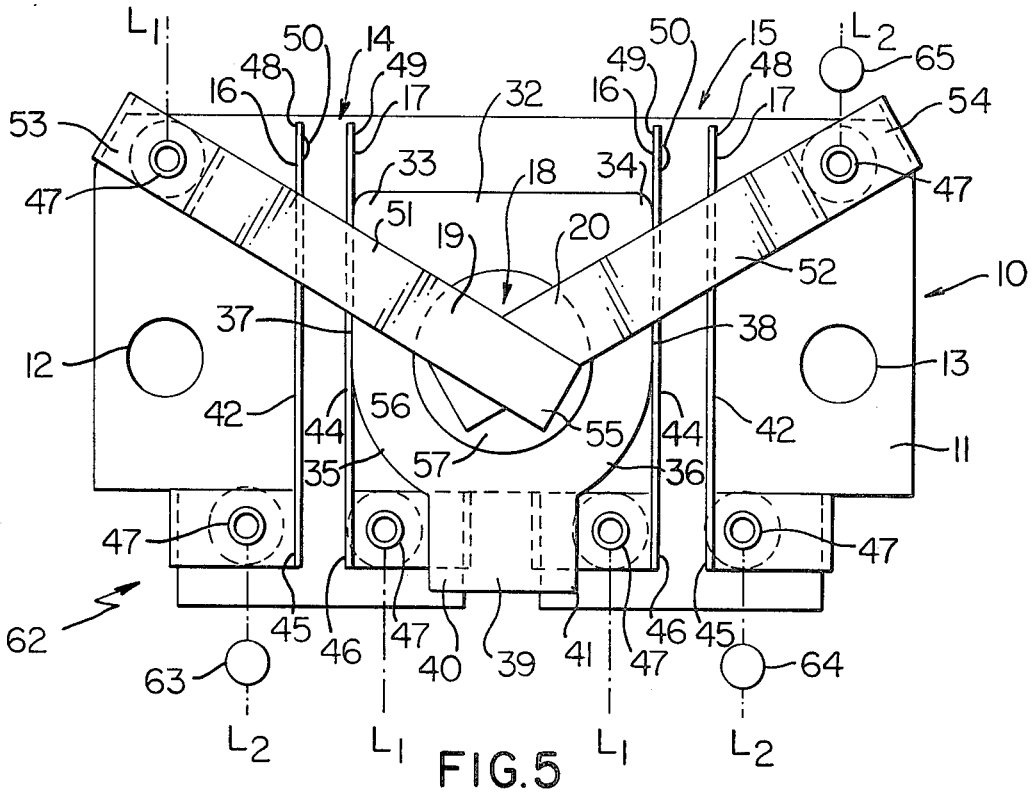
FIG. 5 is a rear view of the electrical switch construction of FIG. 1 and is taken in the direction of the arrows 5—5 of FIG. 1.

Referring now to FIGS. 1–6, the improved electrical switch construction of this invention is generally indicated by the reference numeral 10 and comprises a frame plate 11 for being secured to any desired structure, such as by utilizing mounting holes 12 and 13 thereof as illustrated in FIG. 5, the frame construction 11 carrying two pairs 14 and 15 of contact means 16 and 17 as well as a third pair 18 of contact means 19 and 20 each pair of which is adapted to be opened and closed independently of the other pairs and being operatively associated with a single manipulator means 21 that can operate any pair 14, 15 or 18 of contact means independently of the other pairs of contact means in a manner hereinafter set forth.

The frame member 11 has an opening 22, FIG. 3, passing therethrough and receiving a hollow bushing 23 therein and in which is telescoped a shaft 24 of the manipulator means 21 so as to permit the manipulator shaft 24 to be rotatable relative to the frame member 11 as well as be axially movable relative thereto for a purpose hereinafter described.

The shaft 24 of the manipulator means 21 has a pair of spaced annular grooves 25 and 26 formed therein as illustrated in FIG. 3 and are adapted to respectively receive a section 27 of a coiled detent spring member 28 therein when a particular annular groove 25 or 26 is axially aligned therewith as illustrated in FIGS. 3 or 4 so that the spring 28 will hold the shaft 24 in a particular axial position thereof relative to the frame member 11 until the shaft 24 is manually moved in a manner hereinafter set forth.

The coiled spring 28 has another section 29 thereof disposed in an annular groove 30 formed in a lower extension 31 of the bushing 23 as illustrated so that the bushing 23 will carry the detent spring 28 and permit the section 27 to engage into one of the annular grooves 25 or 26 of the shaft 24 for a purpose hereinafter described.

A cam member 32 is fixed to the shaft 24 and has a profile as illustrated in FIG. 5 which comprises a pair of substantially square corners 33 and 34 and a pair of opposed rounded corners 35 and 36 separated respectively from the corners 33 and 34 by substantially flat parallel sides 37 and 38 which are adapted to be disposed substantially vertically when the manipulator shaft 24 is in the rotational position illustrated in FIG. 5.

If desired, the cam member 32 can have a tongue extension 39 projecting downwardly and medially from the rounded corners 35 and 36 to define corners 40 and 41 for limiting rotational movement of the manipulator shaft 24 in either rotational direction in a manner hereinafter set forth.

The contact means 16 and 17 of the pairs 14 and 15 comprise flexible conductive switch blades 42 and 44 respectively having lower ends 45 and 46 fastened to the frame member 11 by grommet-like conductive rivet means 47 so that the upper ends 48 and 49 thereof are free and have a normal bias to be held spaced from each other as illustrated in FIG. 5.

With the manipulator shaft 24 disposed in the rotational position illustrated in FIG. 5, it can be seen that the switch blades 44 of the pairs 14 and 15 are respectively disposed against the flat sides 37 and 38 of the cam member 32 and have the free ends 49 thereof spaced from the free ends 48 of the cooperating switch blades 42 so as to prevent electrical connection therebetween.

If desired, the free ends 48 and 49 of the switch blades 42 and 44 of the pairs 14 and 15 can be respectively provided with an embossed or added contact means 50 for a purpose hereinafter described.

The pair 18 of contact means 19 and 20 also comprises a pair of flexible conductive switch blades 51 and 52 respectively having ends 53 and 54 secured to the frame member 11 by the grommet-like conductive rivet means 47 so that free ends 55 and 56 thereof will be directed toward each other in overlapping and normal spaced relation as illustrated in FIGS. 1 and 5 for a purpose hereinafter described.

An abuttment member 57 is fastened to end 58 of the manipulator shaft 24 and can comprise a cylindrical section 59 terminating with a conical section 60 so that the apex 61 thereof is disposed directly behind the free end 56 of the switch blade 52 to be engageable therewith for a purpose hereinafter described.

Figure 6:
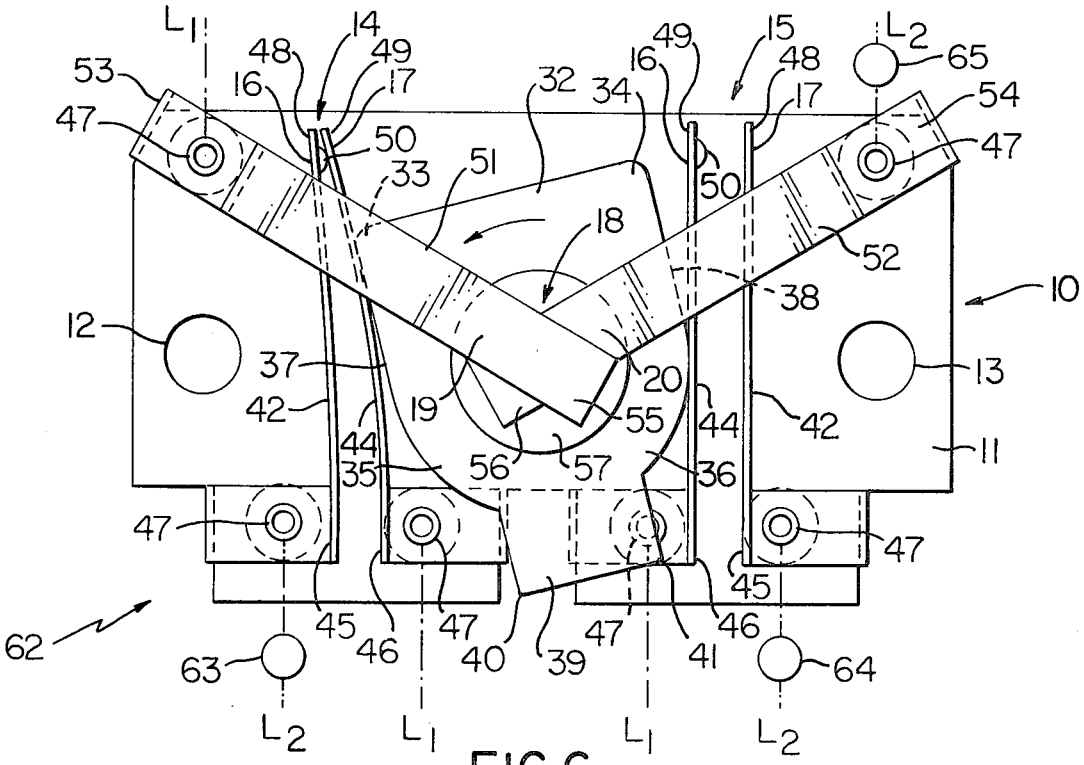
FIG. 6 is a view similar to FIG. 5 and illustrates the switch construction in another operating condition thereof.

The abuttment member 57, cam member 32 and frame member 11 of the switch construction 10 of this invention are each formed from a suitable electrical insulating material, such as plastic material, while the rivet means 47 and switch blades 42, 44, 51 and 52 are formed of electrically conductive material to permit the switch construction 10 to be electrically interconnected into an electrical system of this invention which is generally indicated by the reference numeral 62 in FIGS. 5 and 6 and will now be described.

The electrical switch system 62 of this invention can comprise an electronic alarm clock system that has a liquid crystal digital time indicating display (not shown) as well as an alarm setting liquid crystal display (not shown) which are conventional in the art and are respectively adapted to be set by interconnecting suitable electrical mechanism across power source leads L1 and L2 arranged in the manner illustrated in FIGS. 5 and 6.

In particular, the power source leads L1 are respectively electrically interconnected to the rivet means 47 of the switch blades 44 and 51 of the pairs 14, 15 and 18 as illustrated while the power source leads L2 are respectively electrically interconnected to one side of setting mechanism 63, 64 and 65, the other side of setting mechanism 63 being electrically interconnected to the rivet 47 of the switch blade 42 of the pair 14 and the other side of the setting mechanism 64 being electrically interconnected to the terminal 47 of the switch blade 42 of the pair 15 while the other side of the setting mechanism 65 is electrically interconnected to the terminal 47 of the switch blade 52 of the pair 18 for a purpose hereinafter described.

When the setting mechanism 63 of the system 62 is electrically interconnected across the power source leads L1 and L2 by the pair 14 of contact means 16 and 17 being closed in a manner hereinafter set forth and as illustrated in FIG. 6, the setting means 63 will set or run the day timer of the electronic alarm clock system 62 at a rapid rate whereas when the setting means 64 is placed across the power source leads L1 and L2, the setting means 64 will set or run the day timer means of the electronic alarm clock system 62 at a slow rate for more accurate setting thereof.

When the setting means 65 is placed across the power source leads L1 and L2, the setting means 65 will render the day timing means of an electronic alarm clock system 62 inoperative while making the alarm clock setting means of the electronic alarm clock system 62 operative so that at the same time that the mechanism 65 is interconnected across the power source leads L1 and L2, the placing of the setting mechanism 63 also across the power source leads L1 and L2 will permit the alarm clock setting means to be set or run at a rapid rate whereas the combination of placing the setting means 65 and 64 across the power source leads L1 and L2 will cause the alarm clock setting means to be set or run at a slow rate for more accurate setting thereof.

Therefore, it can be seen that the electrical switch construction 10 of this invention can be made by the method of this invention in a simple and economical manner to be utilized in the electronic alarm clock system 62 and cause the same to operate in a manner now to be described.

With the manipulator shaft 24 of the manipulator means 21 being disposed in the out axial position as illustrated in FIG. 1, the pair 18 of contact means 19 and 20 is held in the open position thereof as illustrated through the natural bias of the blades 51 and 52 and with the manipulator shaft 24 being held in the rotational position illustrated in FIG. 5 by the natural bias of the switch blades 44 of the pairs 14 and 15, the pairs 14 and 15 of contact means 16 and 17 are likewise held in the open condition as illustrated whereby the setting mechanisms 63, 64 and 65 of the electronic alarm clock system 62 are in inactivated conditions thereof.

When a person desires to reset the day timer for the electronic alarm clock system 62, the person merely grasps the manipulator shaft 24 and rotates the same in a counter-clockwise direction as illustrated in FIG. 6 to cause the corner 33 of the cam member 32 to bear against the switch blade 44 of the pair 14 and bend the same to the left as illustrated in FIG. 6 so that the free end 49 of the blade 44 is placed into electrical contact with the contact abuttment 50 of the free end 48 of the switch blade 42 to thereby place the fast setting mechanism 63 for the time of day means across the power source leads L1 and L2. In this manner, the time of day indicator continues to run at a fast rate until the manipulator shaft 21 is released and the natural bias of the switch blade 44 of the pair 14 again moves to the right as illustrated in FIG. 5 to open the pair 14 of contact means 16 and 17 and place the manipulator shaft 24 in the normal rotational position illustrated in FIG. 5.

During the closing of the pair 14 of contact means 16 and 17 as illustrated in FIG. 6, it can be seen that the switch blade 42 will bend to left with the switch blade 44 when the free ends 48 and 49 thereof are placed in electrical contact so that over travel of the cam member 32 will be compensated for. However, the amount of leftward bending of the switch blades 42 and 44 of the pair 14 of contact means 16 and 17 is limited by the corner 41 of the tongue 39 of the cam member 32 abutting against the lower end 46 of the switch blade 44 of the pair 15 of contact means 16 and 17 so that the switch blades 42 and 44 of the pair 14 of contact means 16 and 17 will not be overstressed and the clockwise rotation of the cam member 32 in FIG. 6 will be limited by the corner 41 of the tongue 39 of the cam member 32.

Usually the day timer of the electronic alarm clock system 62 is set or run at a rapid rate with the setting means 63 until the time thereof approaches the desired time setting therefor. At this time, the operation of the setting means 63 is terminated in the manner set forth above and then the slow setting means 64 is utilized to more accurately set or run the time of day setting to the desired time.

In particular, the operator now rotates the manipulator shaft 24 in a clockwise direction in FIG. 5 to cause the corner 34 of the cam member 32 to bend the free end 49 of the switch blade 44 of the pair 15 of contact means 16 and 17 to the right to place the free end 49 into contact with the free end 48 of the switch blade 42 to thereby interconnect the slow setting means 64 across the power source leads L1 and L2, the corner 40 on the tongue 39 of the cam member 32 limiting the amount of clockwise rotation of the cam member 32 in FIG. 5 in a manner previously described for the corner 41 thereof.

Therefore, it can be seen that the slow setting means 64 and fast setting means 63 can be operated independently of each other to set or run the time of day means for the electronic alarm clock system 62 to the desired setting thereof and when the shaft 24 is released, normal bias of the switch blades 44 will always return the shaft 21 to the rotational position illustrated in FIG. 5 whereby the pairs 14 and 15 of contact means 16 and 17 are normally disposed in the open condition thereof and the setting means 63 and 64 are normally inactive.

Figure 2:
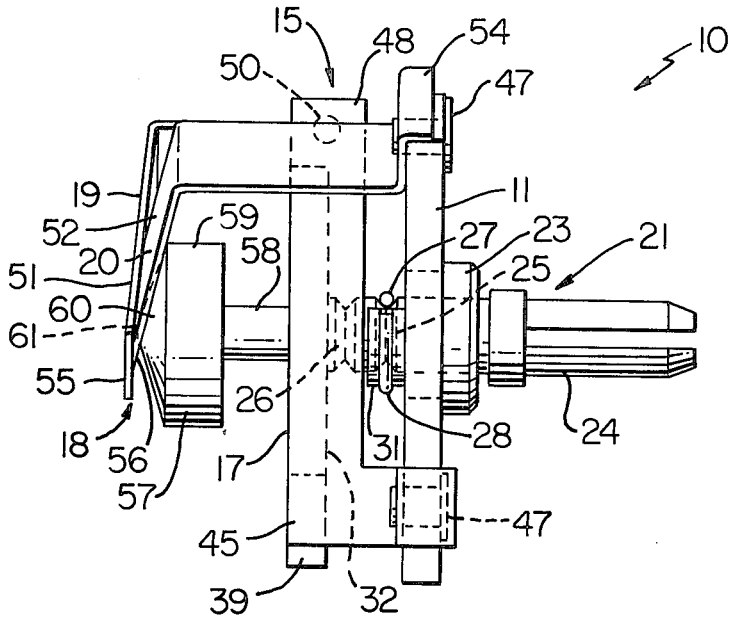
FIG. 2 is a view similar to FIG. 1 and illustrates the switch construction in another operating condition thereof.

When the operator desires to set the alarm means for the electronic alarm clock system 62 to a desired setting thereof, the operator pushes axially inwardly on the manipulator shaft 24 to cause the section 27 of the detent spring 28 to cam out of the annular groove 26 and subsequently be received into the annular groove 25 when the annular groove 25 is aligned therewith as illustrated in FIG. 2 whereby the non-conductive abuttment 57 of the manipulator shaft 24 has moved the free end 56 of the switch blade 20 into electrical contact with the free end 55 of the switch blade 51 to thereby close the pair 18 of contact means 19 and 20 and place the setting means 65 across the power source leads L1 and L2 and render the alarm clock setting means 65 of the system 62 now operable.

Since the detent means 28 now holds the manipulator shaft 24 in the "in" axial condition of FIG. 2, subsequent rotation of the manipulator shaft 24 in the counterclockwise direction as illustrated in FIG. 6 now closes the pair 14 of contact means 16 and 17 to place the fast setting mechanism 63 across the power souce leads L1 and L2 to rapidly run the alarm setting means toward the desired alarm setting time thereof. Of course, when the alarm setting means approaches the desired alarm setting time thereof, the operator rotates the shaft 21 in a clockwise direction in FIG. 5 to cause the slow setting means 65 to now be placed across the power source leads L1 and L2 to thereby more easily set the alarm setting means to the desired setting thereof.

After the alarm setting means of the system 62 has been set in the manner previously described, the manipulator shaft 24 can be pulled to the out axial position illustrated in FIG. 1 to open the pair 18 of contact means 19 and 20 and thereby cause the setting mechanism 65 to be inactive whereby the electrical switch construction 10 will be in the normal condition illustrated in FIGS. 1 and 5.

Therefore, it can be seen that the single manipulator means 21 of the switch construction 10 of this invention can selectively operate any one of at least a pair of contact means independently of the other contact means.

While the system 62 is previously described as being an electronic alarm clock system, it is to be understood that the system 62 could be for other devices as desired.

For example, one such other system could be a range timer arrangement wherein the setting means 63 and 64 can be utilized for setting the time of day clock means of the range timer when the manipulator 21 is in the "out" axial condition of FIG. 1 and for setting an interval timer of the range timer when the manipulator means 21 is in the "in" axial condition of FIG. 2.

Therefore, it can be seen that this invention not only provides an improved electrical switch construction or the like, but also this invention provides an improved method of making such an electrical switch construction or the like.

While the form and method of this invention have been described and illustrated as required by the Patent Statute, it is to be understood that other forms and method steps can be utilized and still fall within the scope of the appended claims.

What is claimed is:

1. In an electrical switch construction having a frame means carrying two pairs of cooperable contact means, each pair of contact means comprising a pair of switch blades carried by said frame means and having free ends that are normally spaced from each other by the natural bias of said blades, a movable manipulator means being carried by said frame means and comprising a shaft that is rotatable in said frame means and extends between said two pairs of switch blades to be adjacent one blade of each pair thereof, a cam member being carried by said shaft and being engageable with said one of said blades of each pair thereof to urge said free end thereof into contact with said free end of the other blade of that respective pair when said shaft is rotated in a certain direction a certain amount, the improvement wherein said cam member has a generally rectangular profile defined by four corners thereof that are disposed transverse to said shaft, two of said corners being generally right angle corners and the other two corners being generally rounded corners, said right angle corners being respectively adjacent said one of said blades of each said pair thereof for engagement therewith, said rounded corners being respectively adjacent said one of said blades of each said pair thereof to prevent engagement therewith when said shaft is rotated.

2. An electrical switch construction as set forth in claim 1 and including a third pair of cooperable contact means carried by said frame means and comprising a pair of switch blades carried by said frame means and having free ends that are normally spaced from each other by the natural bias of said blades, said shaft being axially movable in said frame means and having a free end disposed adjacent one of said blades of said third pair and engaging said one blade to urge said free end thereof into contact with said free end of the other blade of said third pair when said shaft is axially moved in a certain direction a certain amount.

* * * * *